US009242705B2

(12) United States Patent
Elmbo

(10) Patent No.: US 9,242,705 B2
(45) Date of Patent: Jan. 26, 2016

(54) ICEBREAKING VESSEL AND METHOD OF BREAKING ICE

(75) Inventor: Niels Peter Elmbo, Kokkedal (DK)

(73) Assignee: MAERSK SUPPLY SERVICE A/S, Copenhagen K (DK)

( * ) Notice: Subject to any disclaimer, the term of this patent is extended or adjusted under 35 U.S.C. 154(b) by 414 days.

(21) Appl. No.: 13/638,363

(22) PCT Filed: Mar. 31, 2011

(86) PCT No.: PCT/DK2011/050105

§ 371 (c)(1),
(2), (4) Date: Dec. 7, 2012

(87) PCT Pub. No.: WO2011/120528

PCT Pub. Date: Oct. 6, 2011

(65) Prior Publication Data

US 2013/0087088 A1 Apr. 11, 2013

Related U.S. Application Data

(60) Provisional application No. 61/319,474, filed on Mar. 31, 2010, provisional application No. 61/409,677, filed on Nov. 3, 2010.

(30) Foreign Application Priority Data

Mar. 31, 2010 (DK) ..... 2010 70136
Oct. 29, 2010 (DK) ..... 2010 70465

(51) Int. Cl.
*B63B 21/50* (2006.01)
*B63B 35/08* (2006.01)
(Continued)

(52) U.S. Cl.
CPC ..... *B63B 35/083* (2013.01); *B63B 21/16* (2013.01); *B63B 21/50* (2013.01); *B63B 35/08* (2013.01); *B63B 35/086* (2013.01); *B63B 35/12* (2013.01); *B63H 15/00* (2013.01); *B63H 25/42* (2013.01)

(58) Field of Classification Search
CPC ..... B63B 21/50; B63B 35/08; B63B 35/083; B63B 35/086; B63B 35/10; B63B 35/12; B63H 5/00; B63H 5/08; B63H 15/00; E02B 15/02
USPC ..... 114/40–43, 293, 294; 405/217
See application file for complete search history.

(56) References Cited

U.S. PATENT DOCUMENTS 704,155 A * 7/1902 Walters ..... 114/181
3,656,449 A 4/1972 Mead
(Continued)

FOREIGN PATENT DOCUMENTS

CA 1232768 A 2/1988
CA 2684772 A1 11/2008
(Continued)

OTHER PUBLICATIONS

Danish office action for PA 2010 70136, Completed Nov. 12, 2010.
(Continued)

*Primary Examiner* — Ajay Vasudeva
(74) *Attorney, Agent, or Firm* — Brinks Gilson & Lione

(57) ABSTRACT

To keep the water around an off-shore installation (1) free from a harmful impact of ice, a vessel (5) is used to deploy an anchor (6) in a position at a distance from the off-shore installation (1) and in a direction which, seen from the off-shore installation (1), is substantially in parallel with the direction of movement (P) of the ice. By means of the machinery of the vessel, which preferably comprises azimuth propellers, the direction of the anchor line is adjusted and so is the orientation of the vessel relative to the anchor line to the effect that the propellers can be used to crush and dispose of the ice without using energy to hold the vessel up against the pressure of the ice.

21 Claims, 12 Drawing Sheets

(51) Int. Cl.

| | |
|---|---|
| ***B63B 35/12*** | (2006.01) |
| ***B63H 15/00*** | (2006.01) |
| ***B63H 25/42*** | (2006.01) |
| ***B63B 21/16*** | (2006.01) |

(56) References Cited

U.S. PATENT DOCUMENTS

| | | | | |
|---|---|---|---|---|
| 3,837,311 | A | 9/1974 | Lea, Jr. | |
| 3,872,814 | A * | 3/1975 | Rodriguez | 114/40 |
| 3,881,318 | A | 5/1975 | Galloway | |
| 3,886,882 | A | 6/1975 | Thornburg et al. | |
| 3,965,835 | A * | 6/1976 | Bennett | 114/42 |
| 4,215,952 | A | 8/1980 | Baardsen | |
| 4,547,093 | A | 10/1985 | Statham | |
| 4,596,291 | A * | 6/1986 | Makinen et al. | 175/5 |
| 4,716,972 | A | 1/1988 | Makinen et al. | |
| 4,800,831 | A * | 1/1989 | Hellmann et al. | 114/40 |
| 4,942,837 | A * | 7/1990 | Hellmann et al. | 114/40 |
| 5,224,800 | A | 7/1993 | Mogridge | |
| 5,676,083 | A * | 10/1997 | Korsgaard | 114/230.1 |
| 6,216,628 | B1 | 4/2001 | Poldervaart | |
| 7,681,511 | B2 | 3/2010 | Breivik et al. | |
| 8,347,801 | B2 | 1/2013 | Denise | |
| 9,003,987 | B2 * | 4/2015 | Saarinen et al. | 114/40 |
| 9,056,658 | B2 * | 6/2015 | Elmbo | B63B 21/50 114/42 |
| 2003/0131777 | A1 | 7/2003 | Fischer | |
| 2013/0074753 | A1 | 3/2013 | Elmbo | |
| 2013/0087088 | A1 | 4/2013 | Elmbo | |

FOREIGN PATENT DOCUMENTS

| | | | |
|---|---|---|---|
| CN | 201214482 | Y | 4/2009 |
| FR | 2924677 | A1 | 6/2009 |
| GB | 2295372 | A | 5/1996 |
| RU | 2042568 | C1 * | 8/1995 |
| SU | 925752 | A1 * | 5/1982 |
| WO | 2007089152 | A1 | 8/2007 |
| WO | 2007136273 | A1 | 11/2007 |
| WO | 2008116964 | A1 | 10/2008 |
| WO | 2008140654 | A1 | 11/2008 |
| WO | 2009099337 | A1 | 8/2009 |
| WO | 2010103170 | A2 | 9/2010 |

OTHER PUBLICATIONS

Danish office action for PA 2010 70154, Completed Nov. 8, 2011.
Danish office action for PA 2010 70465, Completed Sep. 14, 2011.
International Search Report for PCT/DK2011/50104, mailed Sep. 14, 2011.
Written Opinion for PCT/DK2011/50104, mailed Sep. 14, 2011.
International Type Search Report, mailed Sep. 30, 2011.
International Preliminary Report on Patentability for PCT/DK2011/50104, mailed Oct. 2, 2012.
Office Action for U.S. Appl. No. 13/077,772, mailed Jun. 19, 2013.
International Search Report for PCT/DK2011/050105, mailed Sep. 14, 2011.
Written Opinion for PCT/DK2011/050105, mailed Sep. 14, 2011.
International Preliminary Report on Patentability for PCT/DK2011/050105, mailed Oct. 2, 2012.
Search Report for Finnish Application No. 20126100, Dated Jun. 3, 2015.

* cited by examiner

ICEBREAKING VESSEL AND METHOD OF BREAKING ICE

RELATED APPLICATIONS

This application claims the benefit under 35 U.S.C. §371 of International Patent Application No. PCT/DK2011/050105, having an international filing date of Mar. 31, 2011, which claims priority to Danish Patent Application No. PA 2010 70136, filed Mar. 31, 2010, U.S. Provisional Application No. 61/319,474, filed Mar. 31, 2010, Danish Patent Application No. PA 2010 70465, filed Oct. 29, 2010, and U.S. Provisional Application No. 61/409,677, filed Nov. 3, 2010, the contents of all of which are incorporated herein by reference in their entirety.

The invention relates to a vessel as set forth in the introductory part to claim 1.

The vessel is for breaking ice drifting in a predominant direction relative to an off-shore installation such as eg a drilling vessel. The ice drifts with the current, but it is also influenced by the wind.

It is very important that off-shore installations in ice-filled waters are protected against the impacts of the ice. For instance, an oil or gas platform may be concerned.

In the following description, a drilling vessel will be used as an example of an off-shore installation. Upon impact, a drilling vessel must usually not be shifted more than about 2% of the depth of the water before the drilling operation has to be discontinued, and, if it is shifted about 5%, the drill pipe must usually be disconnected. It is therefore to be understood that impacts from ice, in particular in shallow waters, are extremely critical.

Under no circumstances should large pieces of ice be allowed to hit the drilling vessel.

It is known within the prior art to use several, typically three, powerful icebreakers that cooperate (ice management) to ensure that large chunks of ice cannot drift towards the platform or that the ice is not capable of packing around it.

It usually takes place by the vessels cooperating to the effect that the ice is gradually broken on its way towards the offshore installation.

Pack ice and ridged ice are the types of ice that it takes the largest amount of energy to avoid. It is assumed that by means of conventional icebreakers it may be necessary with a machine power of upwards of 60-70 Megawatt, when the ice is thick and the current is heavy.

That magnitude of machine power is comparable with nuclear-powered vessels, and in view of the fact that three vessels are often used, it will be understood that it is extremely resource-demanding and cost-intensive to secure a drilling vessel against the impacts of the ice.

The object of the invention is to provide a vessel and a method which are considerably more resource-saving than the prior art.

The object is achieved by the vessel comprising a first and a second opening through which anchor lines may travel into the water; and by said openings being located below (deeper than) the propeller shaft of the vessel, said first opening being arranged between the midship point of the vessel (ie the midpoint of the vessel in the longitudinal direction thereof, which is also designated midship point) and the bow of the vessel, and said second opening being arranged between the midship point of the vessel and the stern of the vessel.

By providing the vessel with two openings arranged in bow and stern, respectively, the vessel is capable of carrying out icebreaking with either the stern or the bow facing in the direction of movement of the ice, according to crew's choosing.

By furthermore locating the openings through which the anchor lines travel outwards below sea level, it is accomplished that anchor line is not impacted by the ice, and hence the torquing on the vessel is avoided which might otherwise occur as a consequence of the ice influencing the anchor line.

According to the prior art one would, when one tethers a vessel to an anchor, secure the anchor line to the vessel at a large distance from the natural pivot point of the vessel. Thereby one achieves that the vessel will—due to the momentum created thereby between point of attachment and pivot point—seek to maintain a fixed orientation relative to the ice/current or wind that influences the vessel.

By positioning the openings in the vessel and there below, the anchor line is furthermore located in closer proximity to the natural pivot point of the vessel, and thereby it is accomplished that the above-referenced momentum is minimized whereby it becomes easier to freely select a suitable orientation of the vessel, while the latter—under the influence of the forces from the anchor—is moved through the ice, transversally to the direction of movement of the ice and across the bed of the water under the influence of the ice.

According to an embodiment of the vessel, the second opening through which the anchor line travels into the water is arranged—substantially—halfway between the midpoint of the vessel and the stern of the vessel.

Positioning of the opening for the anchor line in that place means that the vessel needs less fuel for maneuvering, while simultaneously a sufficiently straightening momentum is maintained between the opening through which the anchor line travels and the natural pivot point of the vessel.

In this embodiment, the vessel may thus be moved across a surface area of the water without the ice influencing the anchor line and without the need for inexpediently much energy for maintaining a course/orientation which is favourable for icebreaking.

In practice, the ice also changes direction, and often no one will know in advance which direction it will change into. Therefore, the vessel may be equipped to deploy two or more anchors. Thereby, the vessel may use to advantage the pull from the one or the other anchor line for icebreaking. Of course, according to such embodiment, the vessel may also use the pull from two or more anchor lines for icebreaking and, likewise, the anchor handling winches may—by suitable deployment of several anchors—be utilised as powering means for moving the vessel transversally to the direction of movement of the ice.

According to one embodiment of the invention, the vessel has two openings arranged below the water line, and both between the midship point of the vessel and the stern.

According to one embodiment of the invention, the vessel has two openings arranged below the water line and both between the midship point of the vessel and the bow.

According to one embodiment, an icebreaking supply vessel with one or two azimuth propellers is used, i.e. propellers that can be rotated 360° about an essentially vertical axis. Usually, the vessel has lateral propellers, too, but they play a minor part compared to the azimuth propellers, in particular when it is the heel that is made to face towards the ice. Thereby the azimuth propellers may, on the one hand, grind the ice and, on the other, push the ice chunks away along with the propeller water.

When the heel is disposed against the ice, the anchor handling winch can be used to pull the vessel upwards against the movement of the ice to the effect that machine power is used only to grind the ice and to push the ice around the drilling vessel.

By using vessels according to the invention, a larger number of vessels can be anchored and operate quite closely to the drilling platform without an ensuring risk of them colliding. Thereby the water around the drilling vessel can be kept free of ice in a particularly efficient manner, and much money can be saved on ice-doublings of the drilling vessel.

Embodiments of the invention will be set forth in the dependent claims.

The invention also relates to a method as set forth in claims 7-10.

The text mentions the use of azimuth propellers; of course, they can also be other means providing motive force/thrusters/propellers known to the person skilled in the art, and they can also be constituted of the so-called azipod propellers.

By the phrase "expanse of the vessel" is intended the area comprised by:

the largest length of the vessel, and the largest width of the vessel.

The largest length and the largest width of the vessel are also designated: L.O.A/Width.

The invention will now be explained in further detail with reference to a number of embodiments, reference being made to the drawing, wherein:

FIG. 3 shows an alternative embodiment of a method for icebreaking within a given area; while

Figure 1:
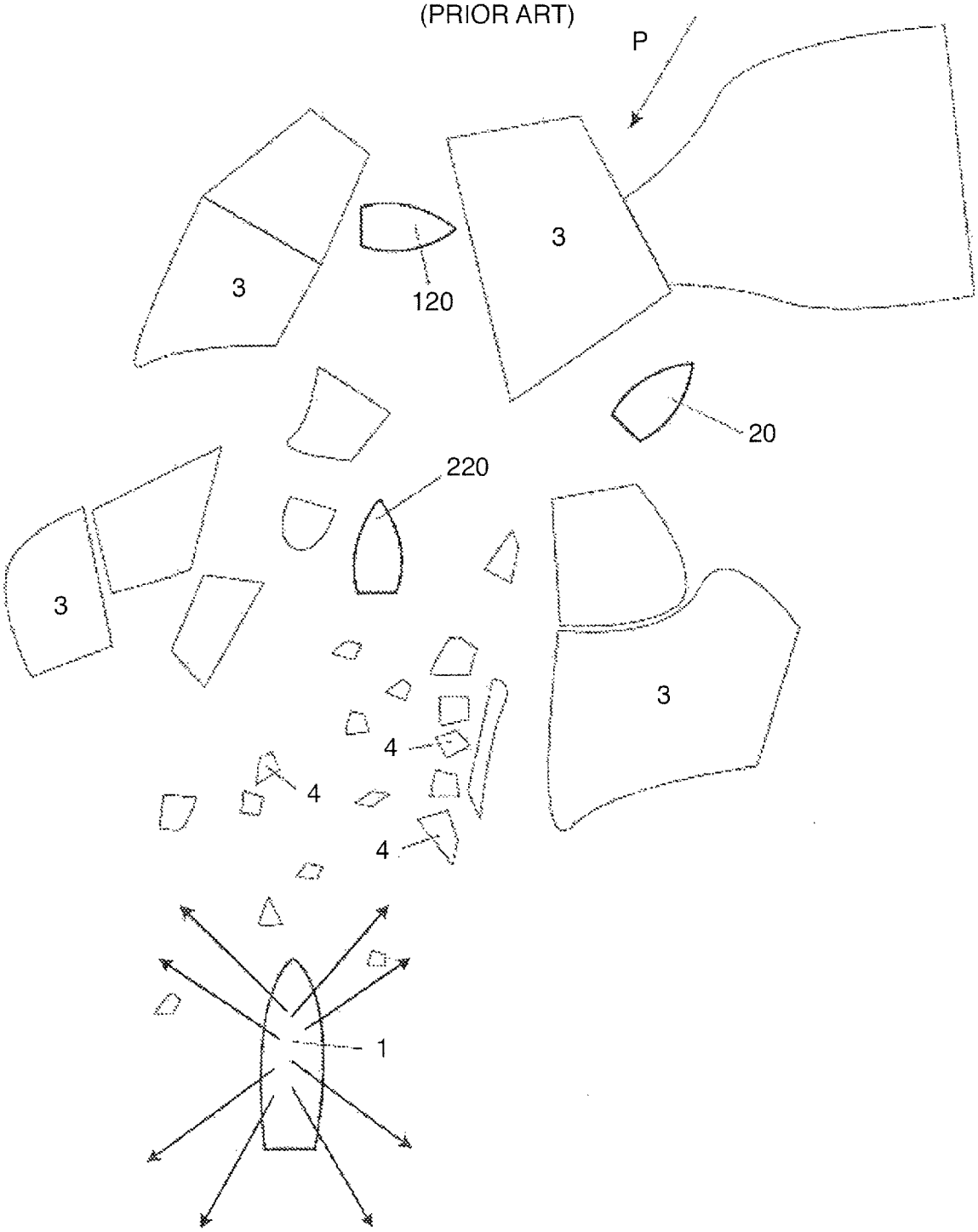
Fig. 1 (PRIOR ART)
FIG. 1 illustrates the prior art.

FIG. 1 shows a drilling vessel 1 in Arctic waters. The drilling vessel is retained by means of eg eight anchors. However, the number of anchor lines is not decisive to the invention. The associated anchor lines are illustrated by means of the eight arrows in the figure. FIG. 1 also shows a number of large ice floes 3 that are broken by means of icebreakers 102, 220 to the effect that only relatively few and small chunks of ice 4 drift along and past the drilling vessel, since the ice drifts in the direction of the shown arrow P. If an ice floe the size of floes 3 hits the drilling vessel, the anchors thereof cannot uphold the requisite, exact position.

Icebreakers 120 and 220 are usually in mutual communication with one another to obtain the most efficient icebreaking possible. However, this does not prevent the energy consumption onboard the three vessels to be high, see the explanation of this in the introduction. The invention entails a considerable reduction in the consumption of resources necessary for breaking the ice sufficiently.

Figure 2:
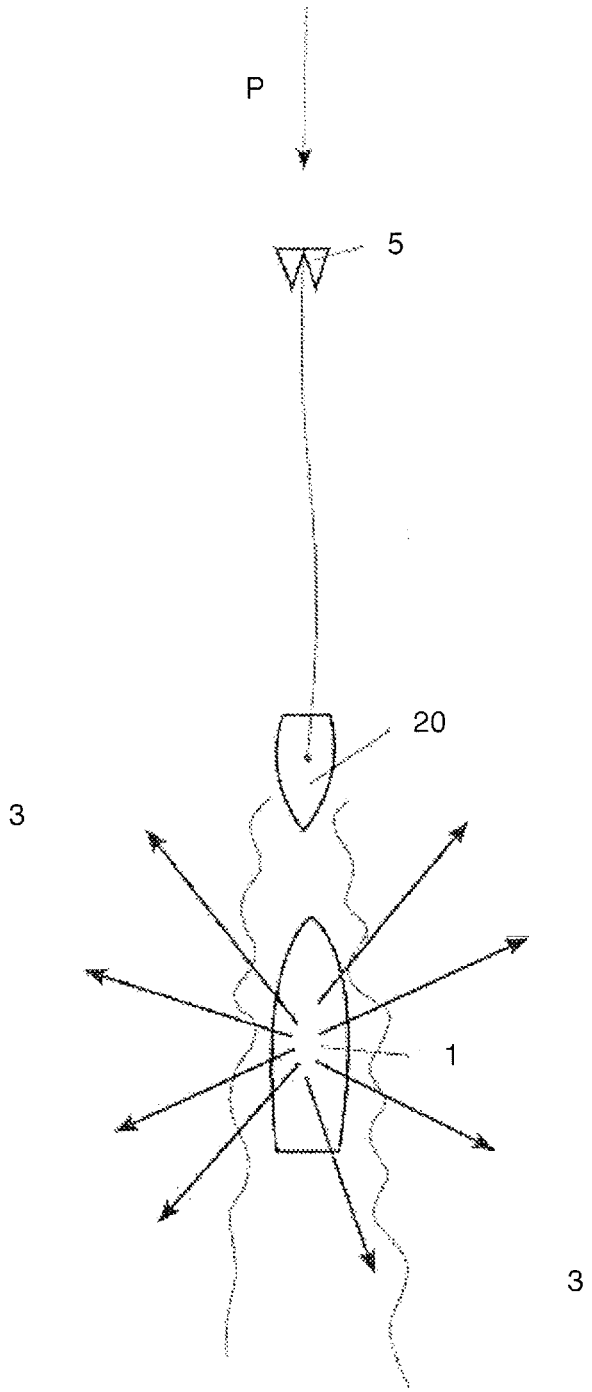
FIG. 2 shows an embodiment of a method for ice management.

FIG. 2 illustrates a method whereby a vessel 20, eg an ice-breaking supply vessel, goes sailing and sets an anchor 5 to the effect that the vessel 20 will go in the direction of the drilling vessel 1 when the anchor line is deployed. The anchor line may typically have a length of 1000 m (depending on the depth of water, but typically it is three times the depth of water). The ice moves essentially in the direction of the arrow P.

The mere fact that the vessel 20 is still without active motive-power machinery will entail that the ice which is moving towards the drilling vessel 1 is broken. It will appear from the figure that the vessel turns the heel towards the ice, and by means of a pair of fixed propellers, it is easy to turn the vessel relative to the direction of movement of the ice (see below) and to thereby use to advantage the pressure exerted by the ice to shift the vessel 20 transversally of the direction of movement of the ice. Of course, the vessel may also face the ice with its bow.

Figure 3:
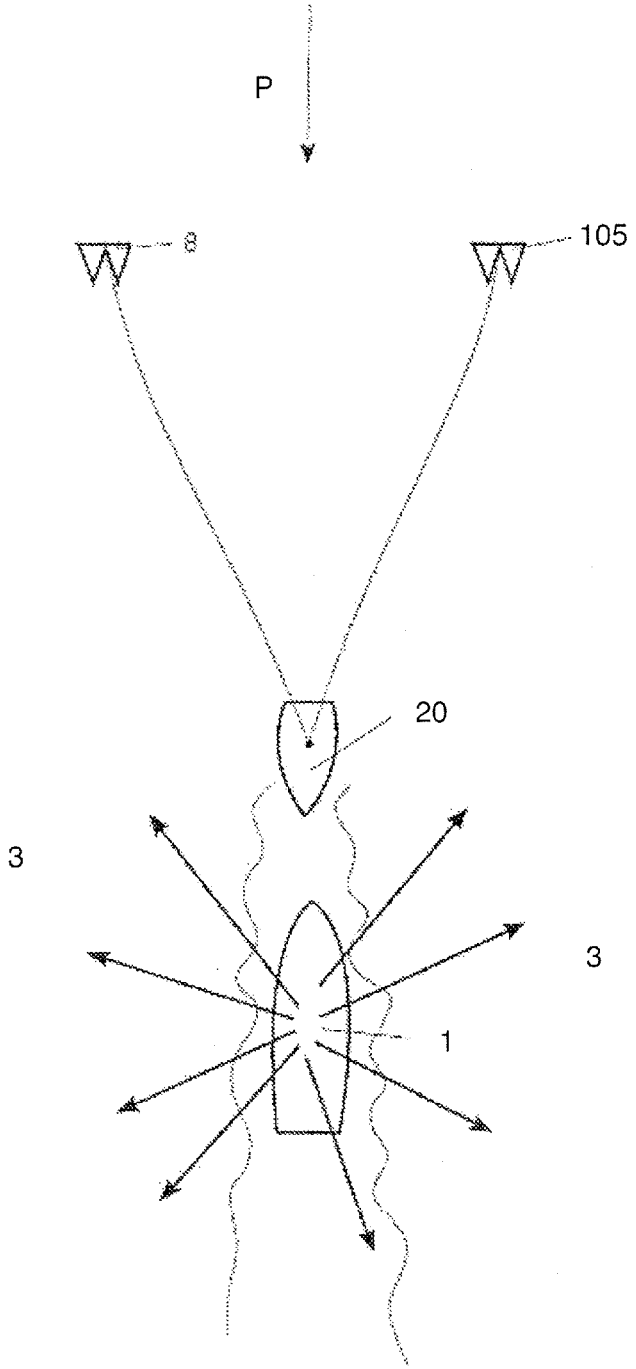

FIG. 3 shows an alternative or a supplementary method for shifting the vessel 20 in the transverse direction to the effect that a sufficiently wide belt is provided where the ice is rendered harmless. This is done by deployment of two anchors 5 and 105 and by utilizing the anchor handling winches of the respective anchor lines to balance the forces in and the lengths of the anchor lines to the effect that such measure contributes to controlling the position of the vessel. By simultaneous use of the propellers, the captain has many options for breaking the ice optimally.

According to one embodiment one (or more) icebreaking supply vessel(s) is (are) used that are provided with eg an azimuth propeller at both sides in the stern of the vessel. Those propellers that can be rotated 360° are particularly efficient for use in the exercise of the method according to the invention. When the anchor line holds the vessel up against the pressure of the ice, the propellers can be set in a transverse position to the effect that they both press the one side of the vessel towards the ice. Thereby, the propeller close to the ice crushes the ice, while the other disposes of the ice with the propeller water.

Figure 4:
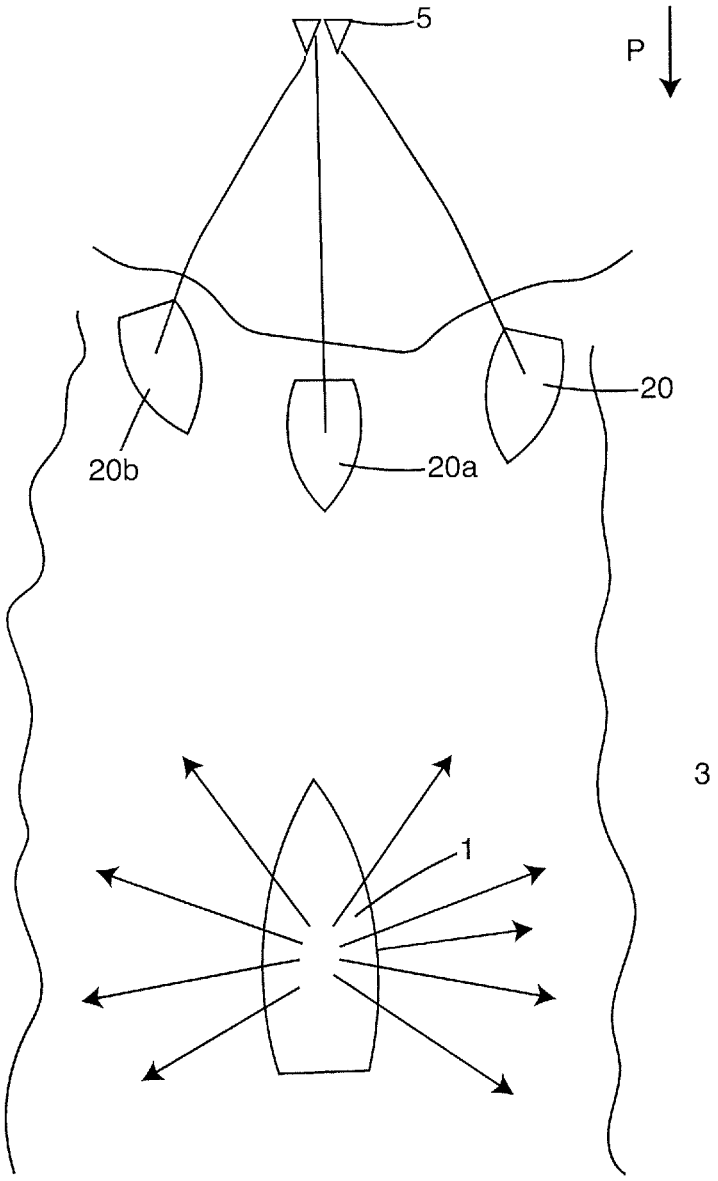
FIG. 4 illustrates ice management with a vessel shown in three different positions.

FIG. 4 shows how a vessel 20 anchored by means of an anchor 5 is capable of performing icebreaking operations to protect an offshore installation by the vessel being moved between three different positions 20, 20*a*, 20*b*.

Figure 5:
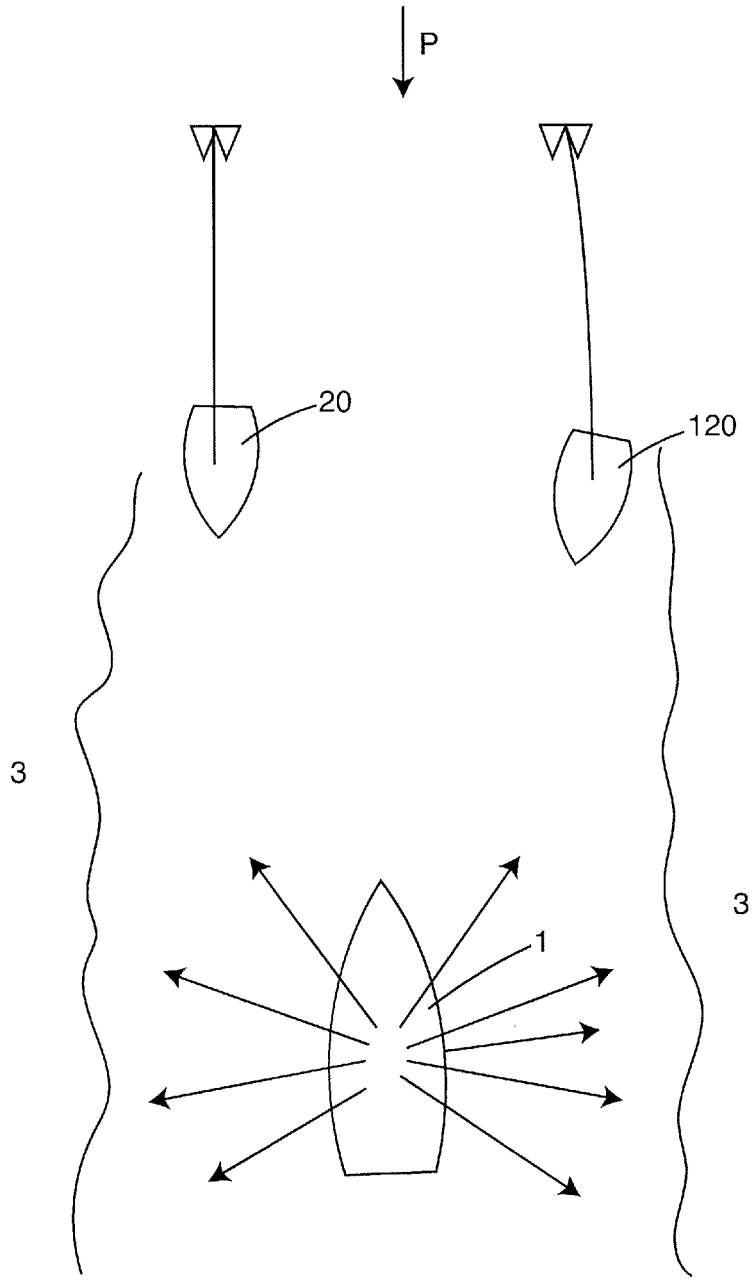
FIG. 5 illustrates ice management by means of two vessels.

FIG. 5 shows a further, alternative embodiment, wherein two vessels 20, 120 (eg icebreaking supply vessels) are used that are anchored by each their anchor 5 and 105, respectively. In this way, the width of the belt where the ice has been rendered harmless is widened, and it is noted that it is possible to situate the vessels 20, 120 fairly close to the drilling vessel 1 without an ensuing risk of them colliding with each other as the very large forces in the direction of movement of the ice are absorbed by the respective anchor lines which are essentially parallel.

Figure 6:
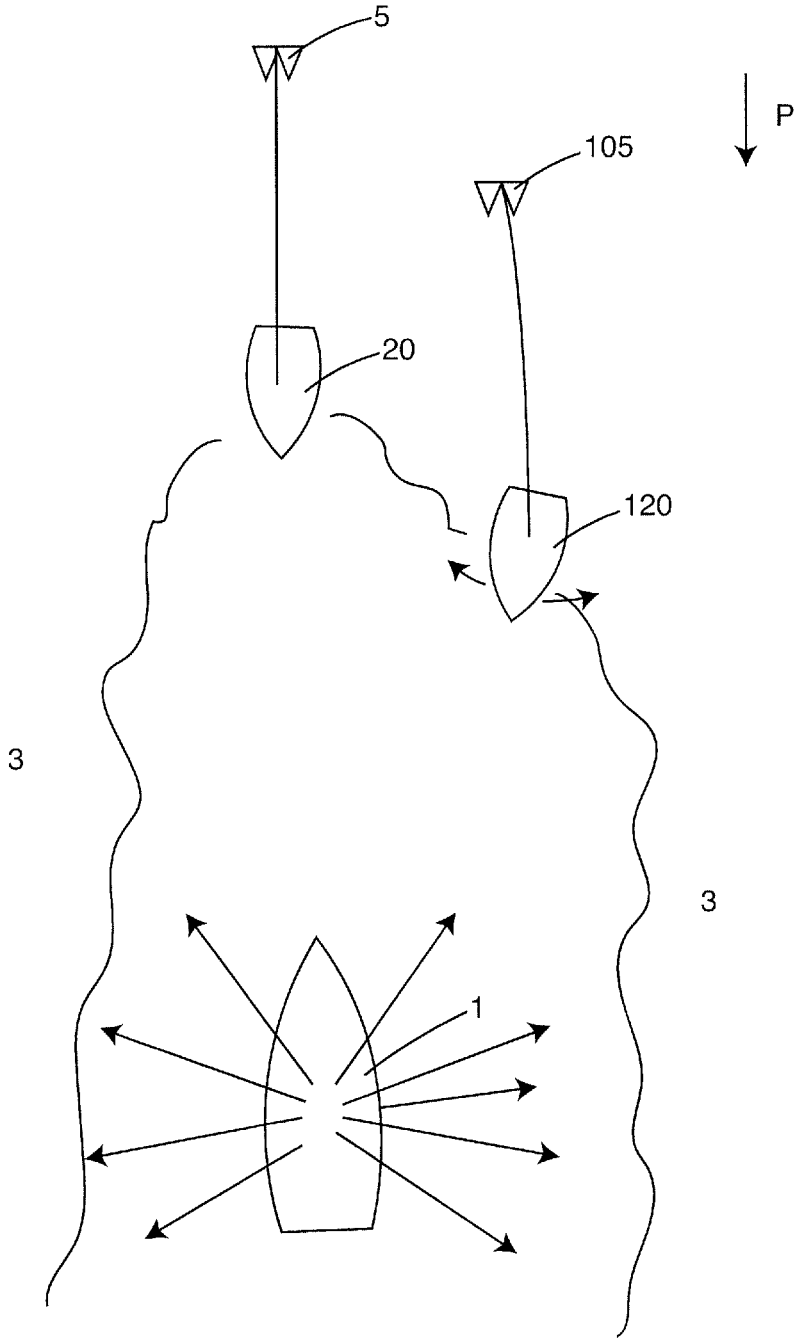
FIG. 6 shows ice management by means of two vessels according to an embodiment of the invention.

FIG. 6 illustrates ice management by means of a method according to the invention, wherein two vessels are used that are mutually displaced relative to the direction of movement of the ice. It is realised by the invention that it may be convenient to allow the one vessel to be almost at a standstill or at a complete standstill (without the use of motor power). Thereby the vessel may (passively without using motor power) break the ice in a belt extending from the vessel and down towards the offshore installation. As mentioned above, this may, in principle, take place without the use of the vessel's propellers. As will appear from the figure, the belt extending from the vessel 20 is slightly offset from the belt to be formed by the second vessel 120, should it also perform a corresponding passive icebreaking.

It has been realised by the invention that a coherent face of ice usually is usually stronger than a face of ice that has been (partially) broken. Thus, the first vessel 20 serves to both break the ice in a direction extending—essentially—down towards the offshore installation, but also to weaken the remaining face of ice that extends down towards the off shore installation. The second ship 120 is thus capable of breaking the ice in a surface area of the water by a power consumption which is reduced compared to that which should have been used to break the ice in a corresponding non-weakened face of ice.

By positioning the vessels in a mutually offset manner it is thus also obtained that the total area where ice is eliminated by two icebreaking vessels can be increased.

Figure 7:
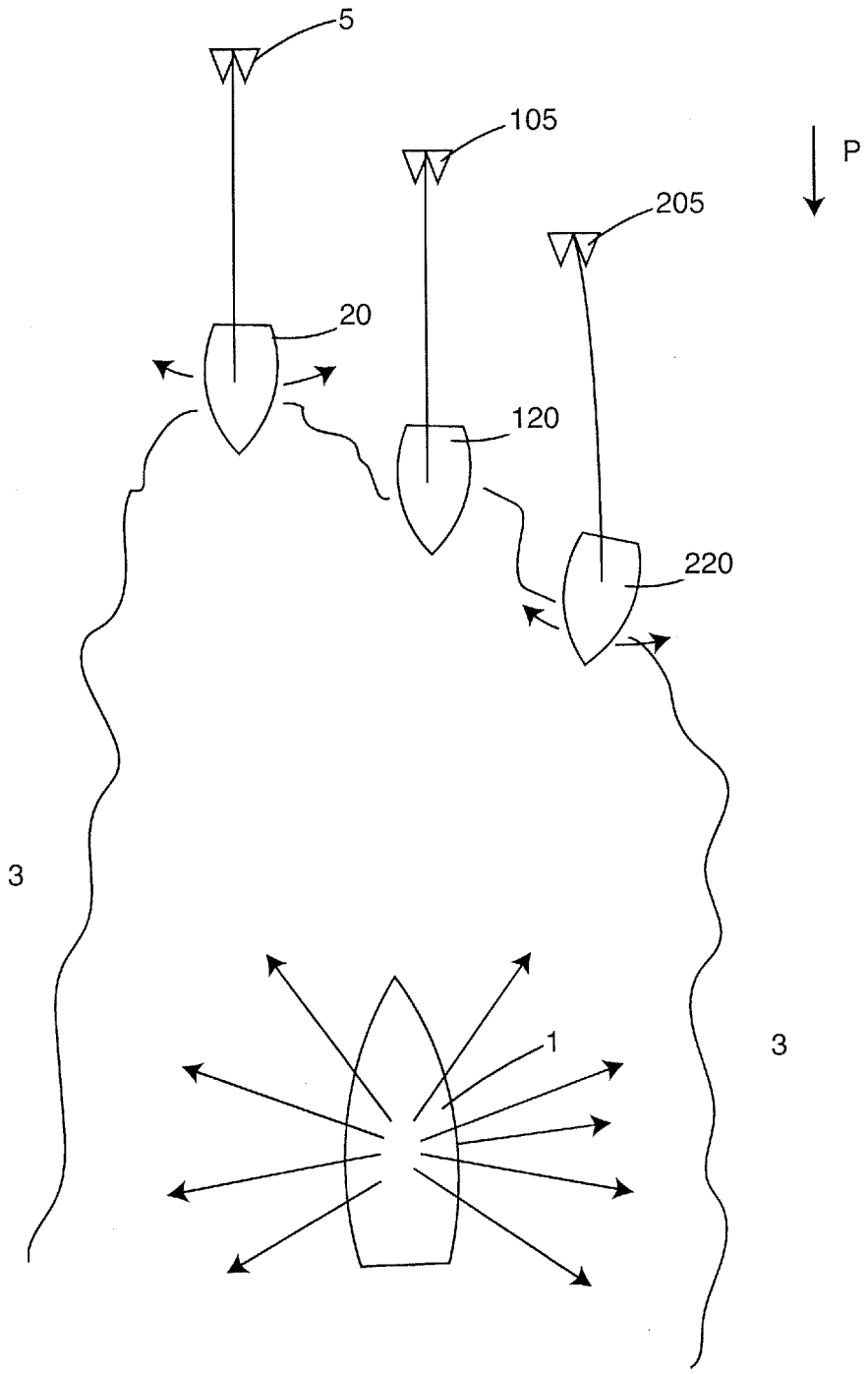
FIG. 7 shows an embodiment of the invention, wherein three vessels are used.

FIG. 7 shows a drilling vessel which can be "protected" by three icebreaking supply vessels 20, 120, and 230 that are anchored by means of respective anchor lines. In principle, the vessel 20 can be at a complete standstill without the use of azipod/azimuth propellers.

In the shown embodiment the vessel to the left 20 is at the largest distance from the drilling vessel, but, of course, that can be varied to the effect that it is the vessel in the middle 120 or the vessel to the right 220 which is most proximate to the drilling vessel. By varying the distance between the icebreaking vessels and the offshore installation, the vessel farthest from the offshore installation—as explained above—can, in principle, be at a standstill without the use of propeller/motor power It is common that the direction of the current/the ice changes. It may therefore also be necessary to move anchors and vessels to continuously eliminate ice and/or render ice harmless around an off-shore installation. In order to monitor the movements of the ice, it is an option to deploy, in an area around the off-shore installation, one or more GPS apparatuses (loggers)—known per se that are capable of determining a position on the basis of satellites—on the ice. Thus, by means of the GPS apparatuses, it is possible to monitor the movement of the ice around the off-shore installation and to obtain a (an early) warning of substantial changes to the direction of movement of the ice. Thereby it is also possible to issue a warning about and to implement movement of anchors in due time to the effect that it is possible to continuously render the ice harmless (or to keep the sea completely free from ice) around the off-shore installation.

Figure 8:
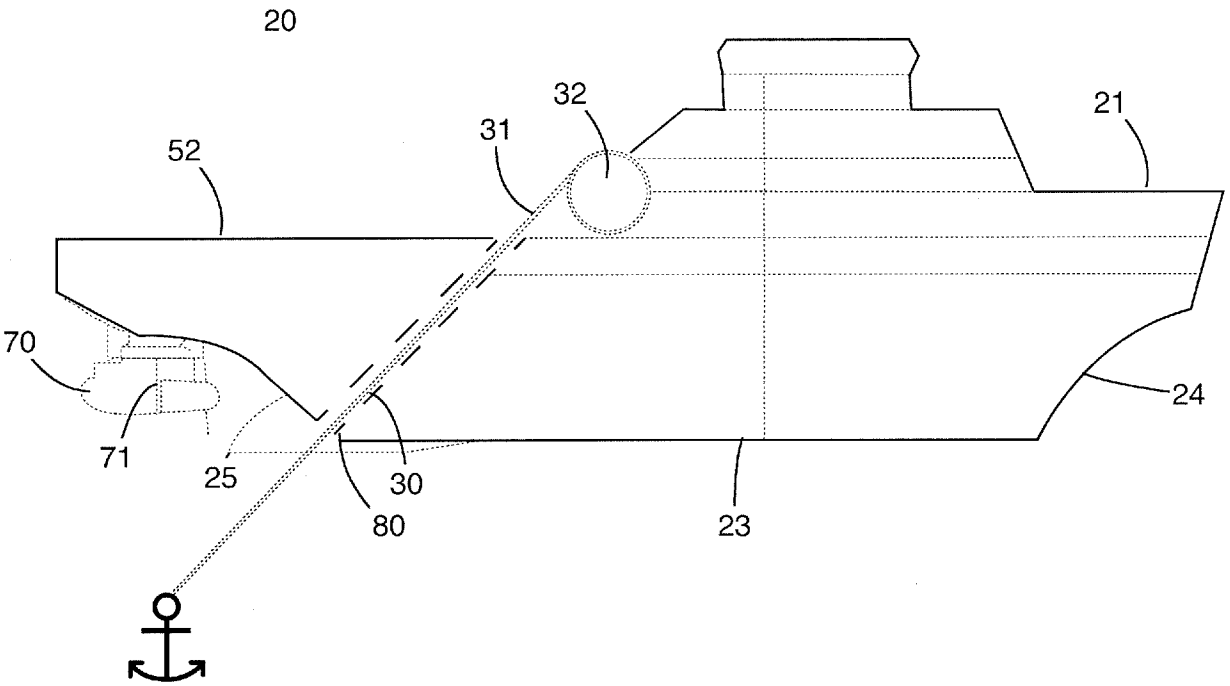
FIG. 8 shows an embodiment of the invention executed on a vessel comprising a so-called "skeg"

FIG. 8 is a schematic sectional view of an embodiment of a vessel according to the invention.

The vessel comprises a bow 21 and a stern 22, both of which are configured with an icebreaking portion 24, 25. They are separated by and are situated above the most deeply situated part of the vessel which—in the embodiment shown, is the so-called flat bottom 23—in the horizontal plane.

In the stern of the vessel, an internal passage 30 is shown which—in the embodiment shown—contains an anchor line 31. At the one end, the anchor line is wound around an anchor handling winch/wheel 32 and, at the other end, it is attached to an anchor (not shown). According to one embodiment of the invention, the opening through which the anchor line passes out into the water is located as far towards the stern as possible, in the flat bottom of the vessel. As far towards the stern as possible usually means so far towards the stern that the opening is caused to be further up than the horizontal plane of the flat bottom. The purpose of arranging the exit opening in the flat bottom of the vessel is to prevent a collision between anchor line and propellers and, to the extent that this can be prevented, the exit opening can, in principle, also be situated in an icebreaking part 24, 25 of the hull of the vessel.

This text uses the term anchor handling winch/wheel which is different from a conventional capstan in that it is usually designed for far greater forces than conventional capstans. Thus, an anchor handling winch may exert pulls of 600-1000 tons (corresponding to about 6,000,000-10.000,000 Newton) and have a braking power of 1,000-1,500 tons (corresponding to about 10,000,000-15,000,000 Newton).

The vessel comprises one or more thruster(s) 70 arranged in the stern 22 of the vessel. In the shown embodiment, the thruster is journalled rotatably about an axis 91. Of course, vessel and thruster (s) may also be made such that one or more thruster (s) is (are) not rotatable.

For the sake of stability as well as performance, the thrusters of the vessel are arranged such that the propellers are located above the deepest profile of the vessel which is usually the horizontal plane of the flat bottom.

As described above, it is realised by the invention that an anchor line can be conveyed out through that part of the bottom which is below the vessel's propellers (thrusters) without the line thereby coming into contact with the vessel's stern propellers (thrusters).

The vessel shown in FIG. 8 comprises a so-called "skeg" 80 whose functionality will be described in the following.

To increase the performance of the stern propellers of an icebreaking vessel, they are sometimes arranged such that a part of the propellers or their blades go deeper into the water than the flat bottom 23 of the vessel. Such vessels are often made with a lowered bottom part called the skeg. In FIG. 8, the skeg is shown by dotted line 80. The skeg is arranged in front (seen relative to the normal direction of sailing of the vessel) of the propellers. The purpose of a skeg is to protect the propellers in shallow waters since "the skeg" will prevent the propellers from hitting the bottom in case of a grounding, if any.

An actual icebreaking vessel can thus be made with "skeg" as shown in FIG. 8, and in such vessels the invention can be executed by allowing the anchor line to pass into the water from a point in "the skeg" that is situated below (deeper than) the vessel's propellers (thrusters).

Hereby it will be obvious to the person having skills within this art that a vessel with an icebreaking hull can be provided with a skeg. It is thus also possible to configure it with a passage for anchor line, wherein the opening conveying the anchor line into the water is arranged in "the skeg" and, more specifically, also to the rear thereof (towards the stern), as shown in FIG. 8. Also with the modifications that are within the ordinary skills of the person skilled in the art.

Figure 9:
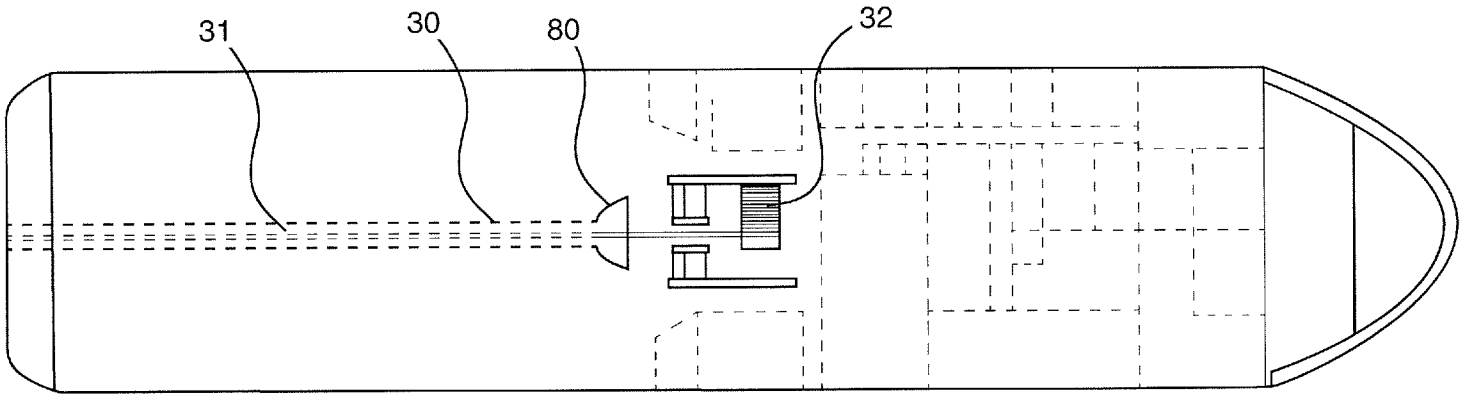
FIG. 9 shows a vessel as shown in FIG. 8, seen from above.
Figure 10:
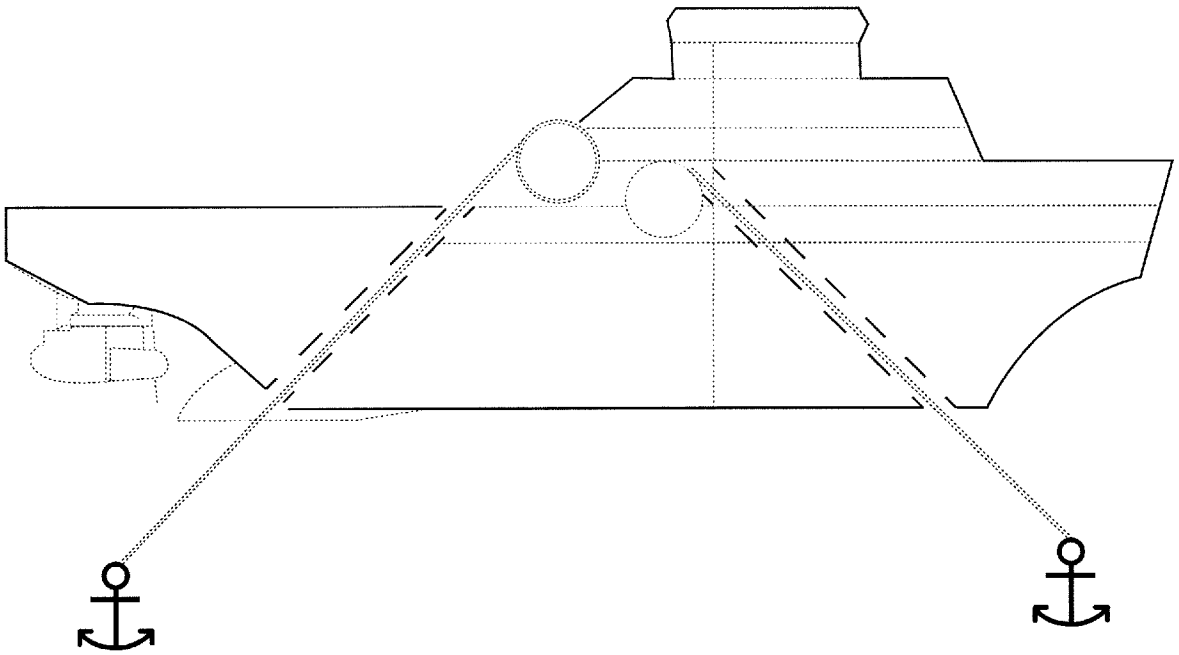
FIG. 10 illustrates an embodiment of a vessel that includes a first opening arranged between a midship point of the vessel and a bow of the vessel, and a second opening arranged between a midship point of the vessel and a stern of the vessel.
Figure 11:
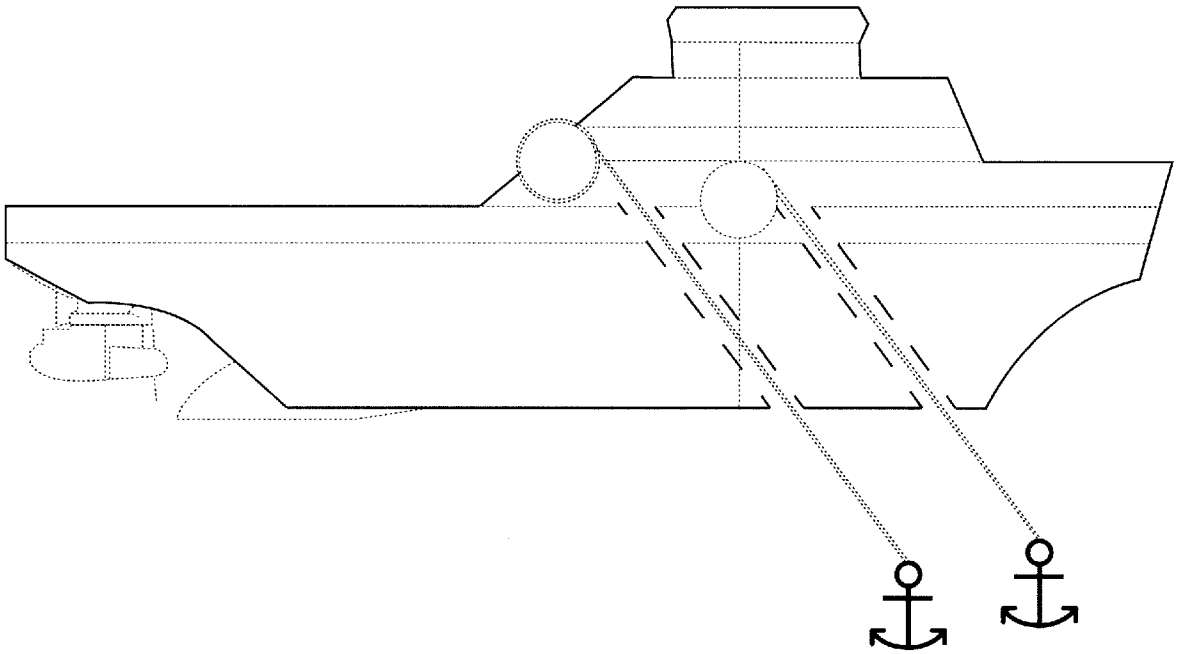
FIG. 11 illustrates an embodiment of a vessel that includes two openings arranged between a midship point of the vessel and a bow of the vessel.
Figure 12:
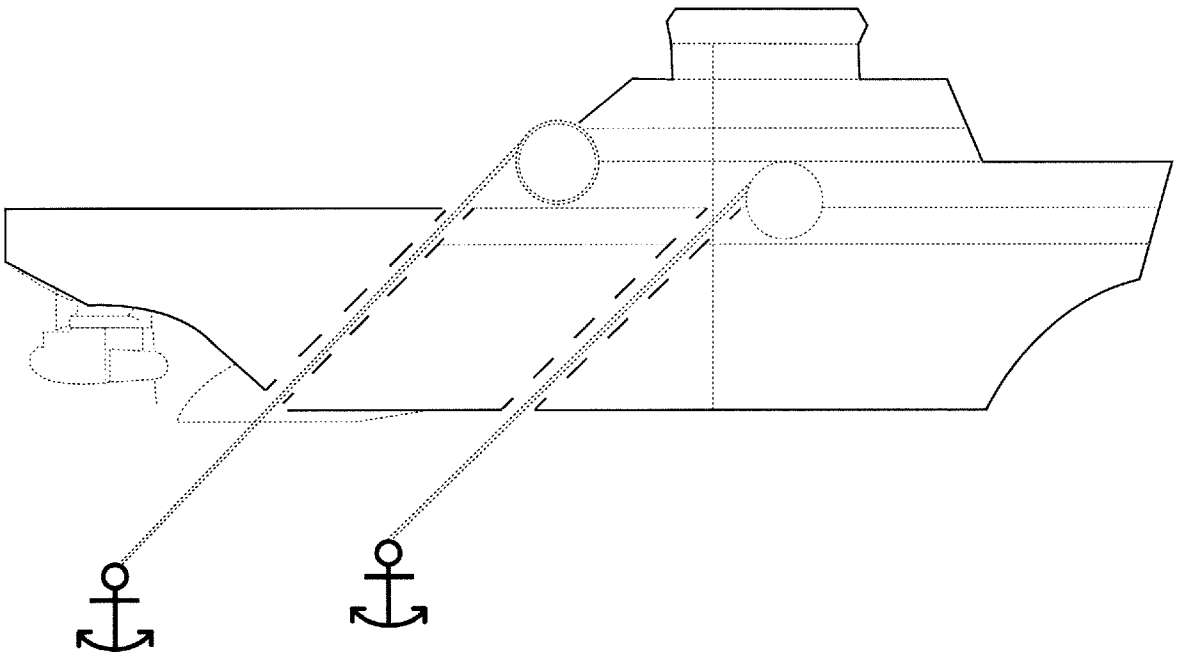
FIG. 12 illustrates an embodiment of a vessel that includes two openings arranged between a midship point of the vessel and a stern of the vessel.

FIG. 9 shows a vessel as shown in FIG. 8, seen from above. Centrally of the vessel, an anchor handling winch 32 is shown which is coupled to an anchor (not shown) via an anchor line 30 extending via an internal passage (outlined behind the funnel) and further out through an opening (not shown either) in the bottom of the vessel.

As will appear from FIG. 8, the anchor line extends from the anchor handling winch into a funnel-like part 80. The purpose of that part 80 is to convey the anchor line from the winch and into the internal passage 31 which extends through the vessel and out through the bottom thereof. The shape of the funnel-like part may of course be varied within the ordinary skills of the person skilled in this art; the essential aspect being that the funnel-like part is capable of capturing the anchor line from the entire width of the anchor handling winch and of conveying it into the internal passage of the vessel.

Other aspects of the invention are:

According to a first aspect of the invention, it is a method in the breaking of ice drifting with a predominant direction relative to an off-shore installation, characterized in that, by means of a vessel, an anchor is deployed in a position at a distance from the off-shore installation and in a direction with is, as seen from the off-shore installation, substantially in parallel with the direction of movement of the ice; and that the machinery of the vessel is used to adjust the direction of the anchor line.

According to a second aspect of the invention, it is a method like in the first embodiment, characterized in that a vessel is used, wherein the machinery comprises one or more azimuth propellers.

According to a third aspect of the invention, it is a method like in the first or the second aspect, characterized in that a vessel is used, wherein the machinery comprises side propellers.

According to a fourth aspect of the invention, it is a method like in the first to third aspects, characterized in that the machinery is used to adjust the direction of the vessel relative to the direction of the anchor line.

According to a fifth aspect of the invention, it is a method like in the first to fourth aspects, characterized in that the vessel is turned such that the heel is facing towards the ice.

According to a sixth aspect of the invention, it is a method like in the fifth aspect, characterized in that the anchor handling winch is used to pull the heel of the vessel upwards against the ice.

According to a seventh aspect of the invention, it is a method like in the first aspect, characterized in that several anchors are deployed in dissimilar directions relative to the off-shore installation.

According to an eighth aspect of the invention, it is a method like in the first to seventh aspects, wherein a number of GPS apparatuses are deployed on the ice, upstream of and at a distance from the off-shore installation, characterized in that information received from the GPS apparatuses is used to detect a change in the direction of movement of the ice; and that this information is used to decide whether one or more anchors are to be moved.

According to a ninth aspect of the invention it relates to a vessel with an icebreaking hull for eliminating or rendering ice harmless in a surface area of water in the proximity of an offshore installation, which vessel comprises:

- an anchor which can be deployed in an anchor line at a distance from the vessel;
- an anchor handling winch capable of winding or unwinding an anchor line through an opening in the vessel;
- motive power means for moving the vessel while it is anchored;

said vessel being capable of performing icebreaking tasks while it is anchored, said vessel being, by means of the motive power means or the anchor handling winch, movable across a surface area of the bed of the sea which has a significantly larger expanse than the expanse of the vessel, whereby the vessel is capable of eliminating or rendering the ice harmless in a surface area of the sea, characterized in that the opening through which the anchor line can pass into the water is arranged below (deeper than) the propeller shaft of the vessel.

According to a tenth aspect of the invention, it relates to a vessel according to the ninth aspect, characterized in that the opening is arranged in proximity of the natural pivot point of the vessel.

According to an eleventh aspect of the invention, it relates to a vessel according to the ninth aspect, characterized in that the opening is arranged as far towards the stern as possible, in the bottom of the vessel, without the opening being caused to be higher up than the horizontal plane of the vessel's bottom.

According to a twelfth aspect of the invention, it relates to a vessel according to the ninth or eleventh aspects, characterized in that the opening is arranged as far towards the stern as possible, in the flat bottom of the vessel, without the opening being caused to be higher up in the horizontal plane of the vessel's bottom.

According to a thirteenth aspect of the invention, it relates to a vessel according to the ninth aspect, characterized in that the opening is arranged as far towards the stern as possible, in the bottom of the vessel, without the opening being caused to be higher up than the lowermost part of the propeller periphery.

According to a fourteenth aspect of the invention, it relates to a vessel according to the ninth aspect, characterized in that the opening is arranged in the flat bottom of the vessel.

According to a fifteenth aspect of the invention, it relates to a vessel according to the ninth or fourteenth aspects, characterized in that the opening is arranged as far towards the stern as possible, in the flat bottom of the vessel.

According to a sixteenth aspect of the invention, it relates to a vessel according to the ninth or fourteenth aspects, characterized in that the opening is arranged as far towards the stern as possible, in the flat bottom of the vessel, without the opening being caused to be higher up in the horizontal plane of the flat bottom.

According to a seventeenth aspect of the invention, it relates to a vessel according to the ninth or 14-16 aspects, characterised in that the opening is arranged as far towards the stern as possible, in the flat bottom of the vessel, without the opening being caused to be higher up than the lowermost part of the propeller periphery.

According to an eighteenth aspect of the invention, it relates to a vessel according to the ninth aspect, characterized in that the opening is arranged in the skeg of the vessel.

According to a nineteenth aspect of the invention, it relates to a vessel according to the ninth or eighteenth aspects, characterized in that the opening is arranged as far towards the stern of the skeg of the vessel as possible.

According to a twentieth aspect of the invention, it relates to a vessel according to the ninth or 18-19 aspects, characterized in that the opening is arranged as far towards the stern of the skeg of the vessel as possible without the opening being caused to be higher up than the lowermost part of the propeller periphery.

According to a twenty-first aspect of the invention, it relates to a vessel according to the ninth aspect, characterized in that the opening through which the anchor line travels out into the water is arranged—substantially—halfway between the midship point of the vessel and the stern of the vessel.

According to a twenty-second aspect of the invention, it relates to a vessel according to the ninth aspect, characterized in that the opening through which the anchor line travels out into the water is arranged between the midship point of the vessel and the stern of the vessel.

According to a twenty-third aspect of the invention, it relates to a vessel according to the ninth or twenty-first aspects, characterized in that the opening through which the anchor line travels out into the water is arranged—substantially—halfway between the midship point of the vessel and the stern of the vessel.

According to a twenty-fourth aspect of the invention, it relates to a vessel according to the 9-23$^{rd}$ aspects, characterised in that the vessel comprises two openings through which anchor lines may travel out into the water; and in that both openings are arranged below the water line of the vessel and between the midship point and the stern of the vessel.

According to a twenty-fifth aspect of the invention, it relates to a vessel according to the ninth or 21-23$^{rd}$ aspects, characterized in that the vessel comprises two openings through which anchor lines may travel out into the water; and in that both openings are arranged below the water line of the vessel and between the midship point and the bow of the vessel.

According to a twenty-sixth aspect of the invention, it relates to a method of breaking ice by use of a vessel according to any one of aspects 9-25, characterized in that:

that the vessel is arranged at a distance from an off-shore installation and in a direction which, as seen from the off-shore installation, is substantially in parallel with the direction of movement of the ice to the effect that the vessels are capable of breaking ice drifting in the direction towards the off-shore installation, that an anchor is deployed in an anchor line which is conveyed through an interior passage in the vessel and out through an opening arranged below the water surface, that the vessel is positioned such that the holding force of the anchor can be transferred from the anchor to the vessel via anchor line and one or more anchor handling winches, that the machinery and/or anchor handling winch is/are used to adjust the direction of the anchor line and/or its length to the effect that the vessel can be moved across a surface area of the sea bed which has a considerably larger expanse than the expanse of the vessel, whereby the vessel is capable of eliminating ice and/or rendering ice harmless in a surface area of the water.

Any of these aspects can be combined with the invention as set forth in any one of the claims.

The invention claimed is:

1. An icebreaking vessel for eliminating or rendering ice harmless in a surface area of water in proximity of an off-shore installation, said vessel comprising:

an anchor configured to be deployed in an anchor line at a distance from the vessel;

motive force means that provide power for moving the vessel while it is anchored;

an anchor handling winch configured to wind or unwind the anchor line through a substantially straight internal passage extending from each of a first opening and a second opening in the vessel arranged below the motive force means of the vessel through to an opening arranged in a top most deck of the vessel, wherein the hull is a mono hull and the first and second openings are arranged in a flat portion defined on the bottom of the hull;

wherein said vessel includes a bow and a stern, both of which are configured with a portion configured to break ice upon contact with the portion while the vessel remains stationary, wherein the vessel is capable of performing icebreaking tasks while it is anchored, said vessel being, by means of the motive force means or the anchor handling winch, movable across a surface area of the bed of the sea which has a significantly larger expanse than the expanse of the vessel, whereby the vessel is capable of eliminating or rendering the ice harmless in a surface area of the sea, wherein said first opening is arranged between the midship point of the vessel and the bow of the vessel, and said second opening is arranged between the midship point of the vessel and the stern of the vessel.

2. The vessel according to claim 1, wherein the vessel has a flat bottom and the first opening is arranged in the flat bottom of the vessel.

3. A vessel according to claim 2, wherein the second opening through which the anchor line passes into the water is arranged substantially halfway between the midpoint of the vessel and the stern of the vessel.

4. A vessel according to claim 3, wherein the second opening is arranged in the flat bottom of the vessel.

5. A vessel according to claim 3, wherein the second opening is arranged in a vessel skeg.

6. A vessel according to claim 2, wherein the vessel has a flat bottom and the second opening is arranged in the flat bottom of the vessel.

7. A vessel according to claim 2, wherein the second opening is arranged in a vessel skeg.

8. The vessel according to claim 1, wherein the second opening through which the anchor line passes into the water is arranged substantially halfway between the midpoint of the vessel and the stern of the vessel.

9. The vessel according to claim 1, wherein the vessel has a flat bottom and the second opening is arranged in the flat bottom of the vessel.

10. The vessel according to claim 1, wherein the second opening is arranged in a vessel skeg.

11. A method of breaking ice comprising:

providing at least two vessels according to claim 1;

arranging the vessels at a distance from an off-shore installation and in a direction which, as seen from the off-shore installation, is substantially in parallel with the direction of movement of the ice to the effect that the vessels are capable of breaking ice drifting in the direction towards the off-shore installation, deploying the anchor in the anchor line from each vessel, positioning the vessels such that the holding force of the anchors can be transferred from the anchors to the vessels via the anchor lines and the one or more anchor handling winches, arranging the vessels to be mutually offset longitudinally of the direction of movement of the ice and at a mutual distance transversally to the direction of movement of the ice and both at a distance from the offshore installation to the effect that the first vessel eliminates and/or renders the ice harmless in a first surface area of the water, while the second vessel eliminates and/or renders the ice harmless in another surface area of the water which extends to the first surface area of the water in which the ice is broken and/or rendered harmless by the first vessel.

12. The method of breaking ice according to claim 11, wherein the first vessel is at a standstill and thereby eliminates and/or renders the ice harmless in a surface area of the water that extends from the first vessel and down towards the off-shore installation.

13. The method of breaking ice according to claim 11, wherein the second vessel uses machinery and/or the one or more anchor handling winches to adjust the direction of the anchor line and/or its length to the effect that the second vessel is moved across a surface area of the sea bed which has a considerably larger expanse than the expanse of the second vessel, whereby the second vessel is capable of eliminating ice and/or rendering ice harmless in a surface area of the water.

14. The method of breaking ice according to claim 12, wherein the second vessel uses machinery and/or the one or more anchor handling winches to adjust the direction of the anchor line and/or its length to the effect that the second vessel is moved across a surface area of the sea bed which has a considerably larger expanse than the expanse of the second vessel, whereby the second vessel is capable of eliminating ice and/or rendering ice harmless in a surface area of the water.

15. An icebreaking vessel for eliminating or rendering ice harmless in a surface area of water in proximity of an offshore installation, said vessel comprising:

an anchor configured to be deployed in an anchor line at a distance from the vessel;

motive force means that provide power for moving the vessel while it is anchored;

an anchor handling winch configured to wind or unwind the anchor line through a substantially straight internal passage extending from each of a first opening and a second opening in the vessel arranged below the motive force means of the vessel through to an opening arranged in a top most deck of the vessel, the first and second openings being arranged between a midsection of the vessel and one of a bow and a stern of the vessel, wherein the hull is a mono hull and the first and second openings are arranged in a flat portion defined on the bottom of the hull;

wherein the bow and the stern of the vessel each comprises a portion configured to break ice upon contact with the portion while the vessel remains stationary, wherein the vessel is capable of performing icebreaking tasks while it is anchored, said vessel being, by the motive force means or the anchor handling winch, movable across a surface area of the bed of the sea which has a significantly larger expanse than the expanse of the vessel, whereby the vessel is capable of eliminating or rendering the ice harmless in a surface area of the sea.

16. The vessel according to claim 15, wherein the first and the second openings are arranged below the waterline and both the openings are arranged between the midship point of the vessel and the stern.

17. The vessel according to claim 16, wherein the vessel has a flat bottom and the first and the second openings are arranged in the flat bottom of the vessel.

18. The vessel according to claim 16, wherein the second opening through which the anchor line passes into the water is arranged substantially halfway between the midpoint of the vessel and the stern of the vessel.

19. The vessel according to claim 15, wherein the first and the second openings are arranged below the waterline and both openings are arranged between the midship point of the vessel and the bow.

20. The vessel according to claim 19, wherein the vessel has a flat bottom and the first and the second openings are arranged in the flat bottom of the vessel.

21. The vessel according to claim 19, wherein the second opening through which the anchor line passes into the water is arranged substantially halfway between the midpoint of the vessel and the stern of the vessel.

* * * * *